US005134832A

United States Patent [19]

Pesendorfer et al.

[11] Patent Number: 5,134,832

[45] Date of Patent: Aug. 4, 1992

[54] METHOD AND APPARATUS FOR COMPILING DEFORMABLE, SUBSTANTIALLY CYLINDRICAL BODIES, PARTICULARLY TAMPONS AND FOR PACKING THEM

[75] Inventors: Fritz Pesendorfer, Bad Honnef, Fed. Rep. of Germany; Karl Schratter, Salzburg, Austria; Josef Schraffl, Gratenau, Austria; Josef Zorzi, Kuchl, Austria

[73] Assignee: McNeil-PPC, Inc., Milltown, N.J.

[21] Appl. No.: 585,114

[22] PCT Filed: Mar. 1, 1990

[86] PCT No.: PCT/EP90/00340

§ 371 Date: Nov. 2, 1990

§ 102(e) Date: Nov. 2, 1990

[87] PCT Pub. No.: WO90/09925

PCT Pub. Date: Sep. 7, 1990

[30] Foreign Application Priority Data

Mar. 2, 1989 [AT] Austria ..... 471/89

[51] Int. Cl.[5] ..... B65B 19/34; B65B 5/08; B65B 5/10

[52] U.S. Cl. ..... 53/444; 53/447; 53/475; 53/148; 53/536; 53/537; 53/540; 53/236; 53/245; 53/247

[58] Field of Search ..... 53/444, 448, 475, 473, 53/536, 532, 236, 245, 247, 540

[56] References Cited

U.S. PATENT DOCUMENTS

| | | | |
|---|---|---|---|
| 3,089,297 | 5/1963 | Craig et al. | 53/444 |
| 3,123,959 | 3/1964 | Carriere et al. | 53/537 X |
| 3,324,622 | 6/1967 | Schmermund | 53/536 X |
| 3,341,036 | 9/1967 | Bardenhagen | 53/148 |
| 3,365,857 | 1/1968 | Liedtke | 53/148 |
| 3,479,795 | 11/1969 | Martin | 53/537 X |
| 3,534,522 | 10/1970 | Liedtke . | |
| 4,008,555 | 2/1977 | Ainoya et al. | 53/148 |
| 4,181,212 | 1/1980 | Hinchcliffe | 53/148 X |
| 4,700,825 | 10/1987 | Mattei et al. | 53/444 X |
| 4,735,032 | 4/1988 | Focke | 53/148 X |

FOREIGN PATENT DOCUMENTS

| | | |
|---|---|---|
| 986685 | 8/1951 | France . |
| 2099798 | 12/1982 | United Kingdom . |

*Primary Examiner*—Horace M. Culver

[57] ABSTRACT

Method and apparatus for compiling deformable, substantially cylindrical bodies and for packing them, comprising vibrating said bodies being positioned at pile delivery substantially parallel adjacent and superposed to each other and being aligned in at least one row of parallelly positioned bodies adjacent to each other, whereafter this row is loaded into a substantially parallelepipedic magazine (6) that is substantially spaceless charged with bodies and thereafter transferred to a magazine discharge station (E) and positioned below a substantially similar transfer magazine (12), into which the bodies are transferred and which is thereafter transversely shifted above a reception space (14) for said bodies into which the bodies enter by gravity and are divided into streams moving downwardly into the area of two or more adjacent discharge devices (17) from which the bodies being compiled to predetermined groups are conveyed at the same time into cups of a cup conveyer (FIG. 4).

4 Claims, 4 Drawing Sheets

Figure 1:
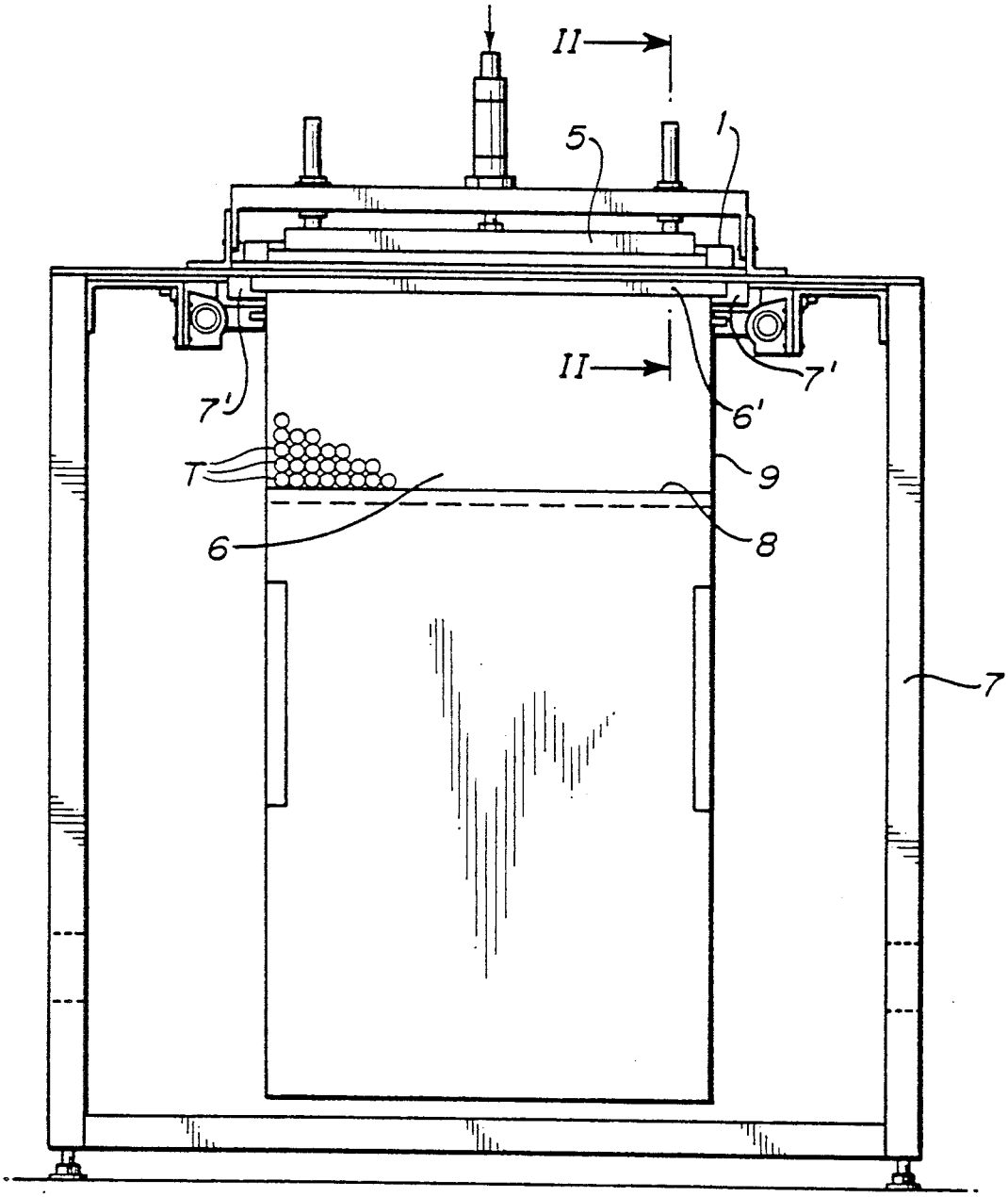

METHOD AND APPARATUS FOR COMPILING DEFORMABLE, SUBSTANTIALLY CYLINDRICAL BODIES, PARTICULARLY TAMPONS AND FOR PACKING THEM

The invention relates to a method and an apparatus for compiling deformable, substantially cylindrical bodies, particularly tampons, and for packing them.

During manufacturing of cylindrical bodies, like tampons, the bodies discharged from the manufacturing machine are generally led to a shaking or vibration compartment in which the bodies being parallel to each other and superposed are aligned in a row at the bottom of said compartment transverse to the longitudinal direction of the bodies. Thereafter, this series of bodies is directly shifted into a package box by means of a slide. But this cyclic operation is relatively slow so that the packing efficiency per time unit is low.

It is an object of the invention to provide a method and an apparatus of the above-mentioned type by which the bodies discharged from the manufacturing machine can be compiled in such a manner that a substantially enhanced packing efficiency at substantially full automatic operation can be achieved.

The method according to the invention for compiling substantially cylindrical bodies, particularly tampons, and for packing them, comprising vibrating said bodies being substantially parallelly stacked and superposed to each other and aligning at least one row of adjacent parallel bodies, whereafter this row is shifted in longitudinal direction of said bodies and fed to a reception means, is characterized in that said row of aligned bodies is placed in a substantially parallelepipedic magazine through a narrow side of said magnetic adapted to the length of said bodies, that said magazine is substantially spaceless charged with a plurality of body rows, whereafter said magazine is transferred to a magazine discharge station and positioned below a substantially similar transfer magazine, that thereafter the bodies are shifted from said magazine upwardly into said transfer magazine which is then moved in transverse direction through a reception space for said bodies with its narrow side being adapted to the length of said bodies which enter said reception space by gravity and are divided into streams moving downwardly into the region of two or more adjacent discharge devices from which said bodies compiled to predetermined groups are shifted at the same time into cups of a cup conveyer.

The subject matter of the invention also comprises an apparatus for carrying out said method having a shaking compartment which is supplied by the manufacturing machine of the bodies, which shaking compartment is open in its bottom area for the passage of a slide which is transversely movable to said compartment, each of the lowermost rows of bodies being cyclically shiftable into a reception means; said apparatus is characterized in that said reception means is a substantially parallelepipedic magazine being chargeable without interstices with a plurality of body rows through a narrow side adapted to the length of the bodies, wherein said magazine is provided with an adjustable bottom which is forceably retained in the side portions of said magazine, and that said magazine is suspended with its upper side in a frame structure receiving a row of magazines being tandem joined below a pressure stamp, the pressure surface of it corresponding to the surface of the inner cross section of said magazine and being movable against said magazine in fixed-cycle operation to press one body row into said magazine at a time.

According to a further embodiment of the invention, the apparatus is characterized in that parallel tracks are provided for receiving said loaded magazine transferred from said frame structure, that at the upper side of the tracks two transfer magazines connected to each other are each transversely shiftable between a first position in which the bodies are moved out of said magazine upwardly into said associated transfer magazine, and a second position in which the loaded transfer magazine discharges the bodies to a reception means being mounted at the lower side of said track and through which the bodies can be supplied to a plurality of adjacent discharge devices by forming groups of bodies.

Thus, the invention in a simple manner achieves a continuous working cycle of the packing operation by which a great drive through-put per time unit is assured. By means of the apparatus according to the invention which takes little space, bodies of different diameters can be packed in boxes of different size.

Figure 2:
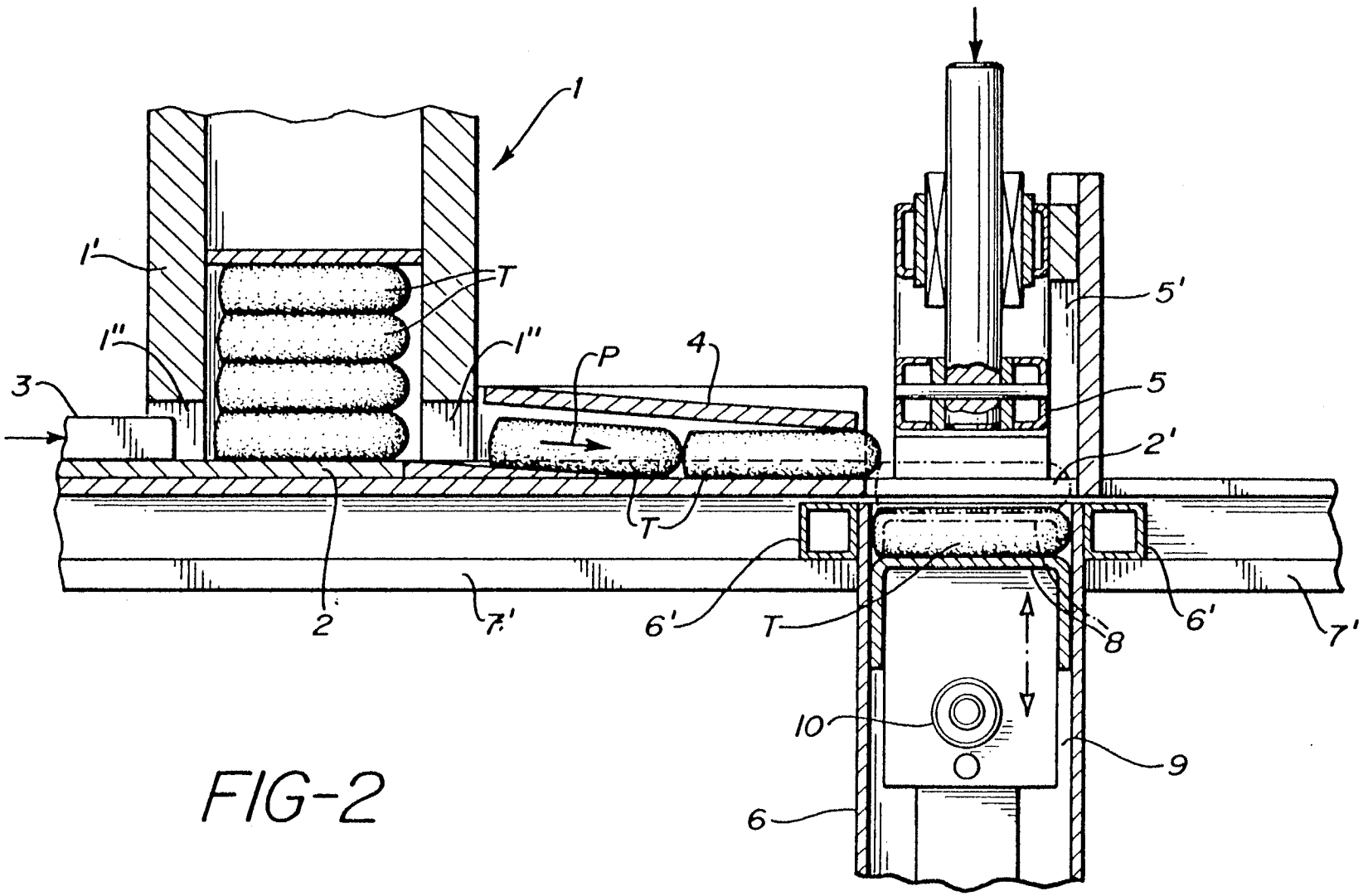
Figure 3:
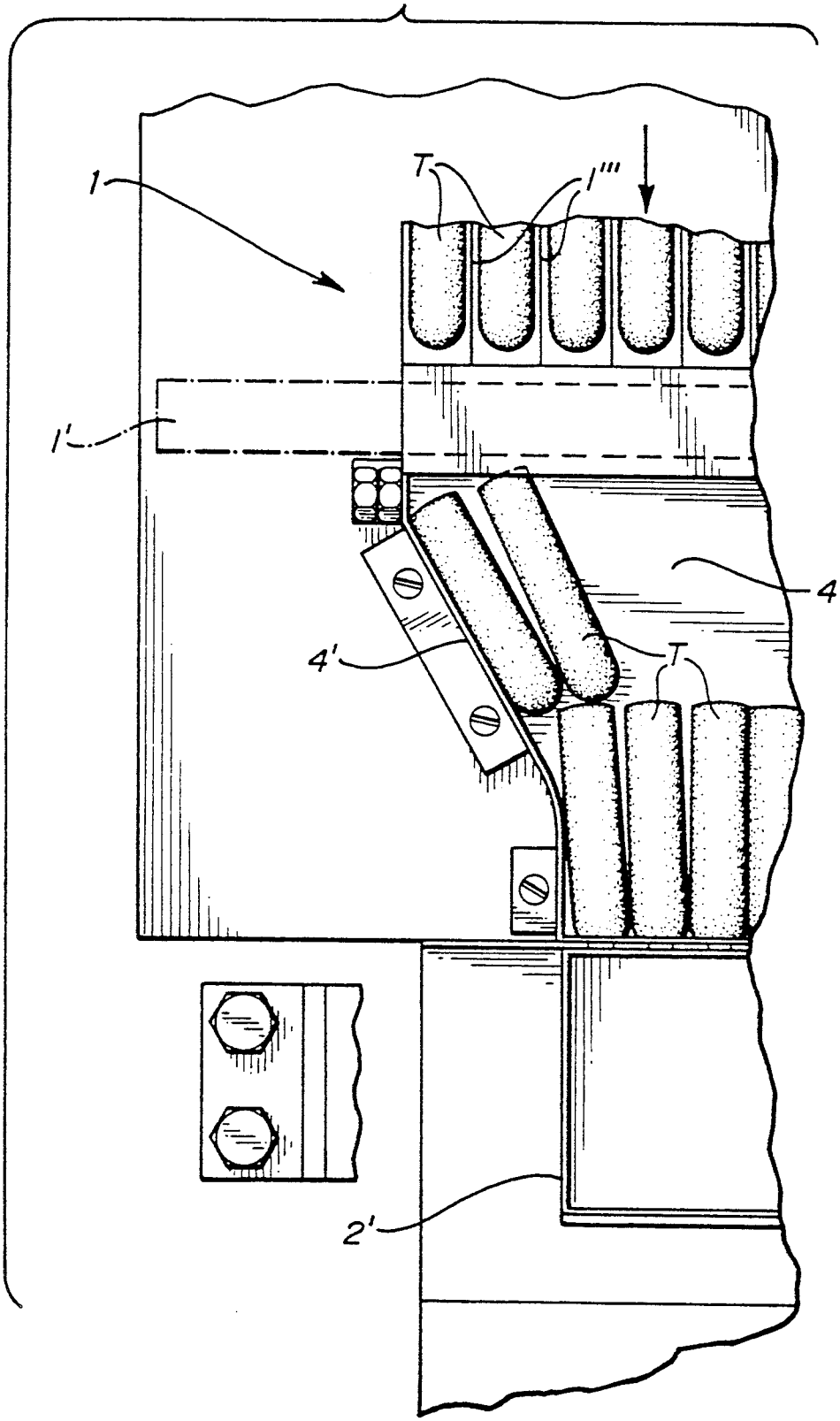
Figure 4:
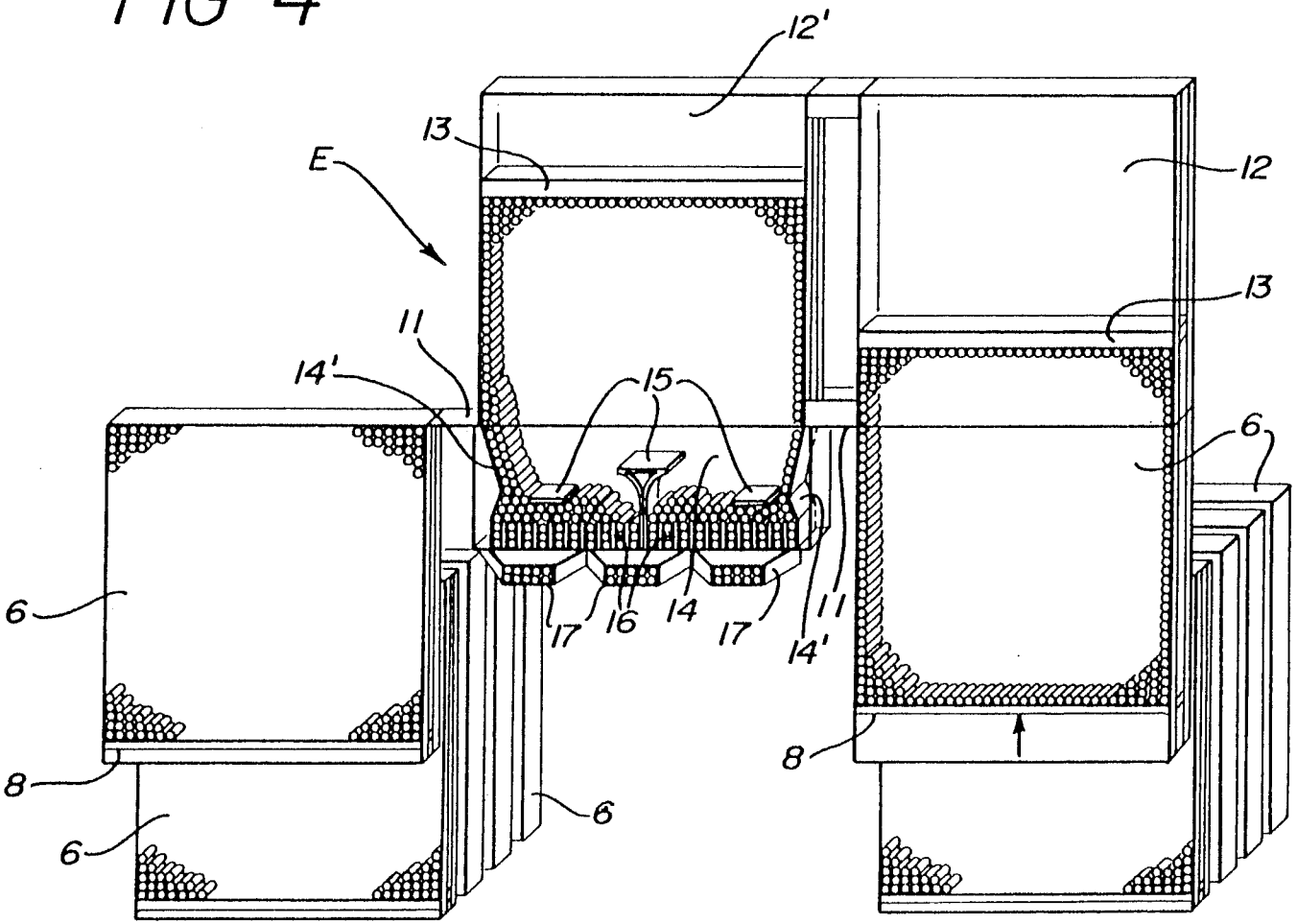

Further features of the invention are disclosed more in detail by means of an example of an embodiment and by reference to the drawings as following:

FIG. 1 shows a schematic front view of a magazine charging station of an apparatus according to the invention, FIG. 2 shows an enlarged cross section through a portion of the station according to line II—II of FIG. 1, FIG. 3 shows an enlarged plan view of a portion of said station of FIG. 1, and FIG. 4 shows a schematic perspective view of a station for a groupwise discharge of bodies to be packed.

A shaking compartment 1 which can vibrate in a horizontal direction and which is only indicated in FIGS. 2 and 3 is, from the right side in FIG. 3, charged with tampons T from a tampon manufacturing machine, not shown. The tampons are conveyed within the shaking department downwardly to a support 2 and to an area of, for instance, a pneumatically activatable slide 3 in such a manner that they are positioned in a transverse row parallel to each other. Sidewalls 1' of the shaking compartment 1 are provided with passage slots 1'' at the bottom side for said slide 3 by means of which each of the lowermost rows of tampons positioned on said support 2 and superposed within said shaking compartment is shifted into a guide 4 in a horizontal direction at one working stroke. This guide 4 receives two tampon rows at a time being positioned in series at the next working stroke of the slide 3, each front row being in front of the feed direction according to arrow P in FIG. 2, is moved from guide 4 into a passage opening 2' of said support 2 within the region of a vertically movable stamp 5. The opening 2' is aligned with the entrance opening of a parallelepipedic magazine 6 positioned below said support 2. The magazine 6 is suspended from tracks 7' of a frame structure 7 by means of profiles 6' which are mounted at the upper end of the sidewall of the magazine 6, which frame structure 7 can receive a plurality of magazines being arranged in series. The stamp 5 being shiftable in a guide 5' and, for instance, pneumatically operable, presses at a time one transverse row of tampons into said magazine 6 at its working stroke. The magazine 6 has an adjustable bottom 8 which is vertically movable in side portions 9 of said magazine and secured therein against movement by means of schematically indicated springs 10 of a predetermined and/or adjustable resistance.

As shown in FIG. 3, the tampons positioned on the support 2 within the shaking compartment 1 are separated by vertical divider plates 1'''. Furthermore it can be seen from this figure that the longitudinal extension of said shaking compartment 1 and said slide 3, respectively, is greater than the corresponding dimension of said magazine 6 and that the guide 4 is provided with sidewalls 4' converging to the magazine in feed direction P. In this manner, a sufficient vibration space is left for the shaking compartment and a spaceless sequence of tampons is assured before their supply to the magazine.

According to FIG. 1 the magazine 6 hanging from said parallel tracks 7' of the frame structure 7 is to a predetermined level or completely supplied with tampons superposed in layers. Thereafter, the magazine 6 supplied with tampons can be conveyed to a magazine discharge or packing station E shown in FIG. 4 by means of a transport car, not shown, which can receive a plurality of magazines positioned in a row, or by means of guide tracks, etc.

In this discharge station E each of the foremost magazines 6 of the magazine row being filled and open at its upper side is lifted in vertical direction against a pair of horizontal tracks 11 and retained in engagement therewith.

At the upper side of said pair of tracks 11 is positioned a transfer magazine 12 associated to and substantially similarly formed as said magazine 6 wherein a bottom 13 of said transfer magazine 12 guided in the side portions of said magazine but vertically freely adjustable is in a lowered position in the first place. Said transfer magazine 12 is movable along the longitudinal direction of said tracks 11. The tampons are transferred from said magazine 6 to said transfer magazine 12 by means of the vertically adjustable magazine bottom 8 and a pressure means engaging said magazine bottom, being not shown, whereby said bottom 13 is moved upwardly. Thereafter, the transfer magazine 12 filled with tampons is moved along the longitudinal direction of said tracks 11 into the area of a tampon-receiving and discharging apparatus.

This receiving and discharging apparatus is provided with a reception space 14 for the tampons at the lower side of said tracks 11, wherein the cross section of the entrance of said reception space corresponds to the cross section of the magazine. The tampons are pressed by the weight of the magazine bottom 13 downwardly into said reception space. The reception space 14 has narrow side walls 14' converging at first downwardly and thereafter diverging again. In said reception space 14 are provided three guide means being horizontally spaced and having the form of horizontal impingement plates 15 the middle one of which is positioned somewhat higher than those being positioned at its sides. The impingement plates 15 divide the tampon stream into four adjacent part streams which flow again together below said plates 15 in such a manner that the tampon stream is loosened up and the tampons are guided in each of several vertical partitions 16 adjacent to each other.

Said partitions 16 are associated with three discharging devices 17 projecting from the front side of the reception space 14 and in which two or more rows of a predetermined number of tampons are superposed each time. The associated groups of tampons are discharged from said discharge devices 17 into each cup chain, now shown, passing in front of said discharge devices 17, wherein the tampons are conveyed by means of said cup chain to boxes into which they are packed.

As shown in FIG. 4, there are provided reception means for the tampon magazines 6 at both sides of said tampon discharge devices 17. Thus the tampon magazines 6 can be fed at two parallel rows. The transfer magazine 12 is connected to an adjacent transfer magazine 12' such that one transfer magazine is loaded at a time, whilst the other is discharged at the same time. In this manner a continuous operation of the discharge devices 17 is achieved by transferring one empty transfer magazine at a time into a receiving position and at the same time transporting one transfer magazine charged with tampons to the area of the reception space 14. Said shifting of the transfer magazines can be realized either by hand or automatically. The size of each of said discharge devices 17 can be varied, if necessary, to adapt the number of tampons to be compiled into one group to the desired package size.

Above the invention has been described by means of an apparatus for packing tampons but it is understood that the invention can also be used in connection with other deformable cylindrical bodies or rows to be packaged groupwise.

We claim:

1. A method for compiling and transporting deformable substantially cylindrical bodies comprising:

a) aligning said bodies side-by-side with their central axes parallel to form a series of parallely stacked and superposed rows of bodies;

b) transferring at least one of said rows in a direction parallel to the longitudinal axis of said bodies to remove said row from said stack;

c) providing a substantially rectangular magazine having a width approximately equivalent to the length of the cylindrical bodies;

d) inserting said at least one row into said magazine through an end of said magazine with the longitudinal axis of said bodies aligned with the width of said magazine;

e) repeating steps b), c) and d) until said magazine is fully charged with cylindrical bodies in a substantially spaceless density;

f) transferring said magazine to a discharge station and positioning said magazine below a transfer magazine;

g) pushing said cylindrical bodies from said magazine upward into said transfer magazine to charge said transfer magazine with said cylindrical bodies;

h) moving said transfer magazine to a position over a discharge device and permitting said bodies to move downwardly from said transfer magazine into said discharge device; and i) providing a conveyor belt having individualized compartments for receiving said cylindrical bodies at an outlet of said discharge device for receiving said cylindrical bodies.

2. An apparatus for transporting cylindrical bodies comprising:

a) a shaking compartment fed from an apparatus for fabricating such cylindrical bodies, said shaking compartment being adapted to align said cylindrical bodies in parallel stacked rows with said bodies lying in a position having their longitudinal axes parallel to one another;

b) a transfer apparatus at an outlet to said shaking compartment having one side open in a direction toward one end of said bodies and a slide means positioned at the other end of said bodies;

c) means for moving said slide means in a direction parallel to the longitudinal direction of said cylindrical bodies in order to transfer one row of said cylindrical bodies out of said shaking compartment;

d) a magazine positioned adjacent said transfer apparatus for receiving said cylindrical bodies, said magazine being substantially rectangular and having a thickness in a direction parallel to the movement of said cylindrical bodies which is substantially equal to the length of said cylindrical bodies, an opening defined by said magazine near a top of said magazine for permitting transfer of said cylindrical bodies into said magazine;

e) a movable bottom to said magazine resiliently biased in an upward position toward said opening defined by said magazine;

f) compression means for forcing each row of cylindrical bodies received by said magazine downward against the resilient force of said bottom to pack said cylindrical bodies within said magazine in a substantially spaceless manner.

3. The apparatus according to claim 2 further comprising:

a) means for moving said magazine once it has been fully charged with cylindrical bodies to a position beneath a transfer magazine having a thickness substantially equal to the length of the cylindrical bodies and said transfer magazine defining an opening in the bottom thereof;

b) means for positioning said magazine and said transfer magazine such that the longitudinal axis of the bodies in the magazine may be aligned with the thickness of the transfer magazine;

c) means for transferring said bodies upward out of said magazine into said transfer magazine;

d) means for moving said transfer magazine from its position above said magazine to a position above a discharge apparatus in a position such that the opening defined in the bottom of said transfer magazine may be positioned in communication with said discharge apparatus to discharge the cylindrical bodies into said discharge apparatus.

4. The apparatus according to claim 3 wherein said discharge apparatus has side portions which are converging along a first portion and diverging along a second portion and further comprises impingement plates which are mounted at a distance to each other in said discharge apparatus to break up agglomerations of said cylindrical bodies which may be caused by the compression within the magazines.

* * * * *